United States Patent [19]

Pressnall et al.

[11] Patent Number: 4,798,150

[45] Date of Patent: Jan. 17, 1989

[54] APPARATUS FOR HANDLING ASH

[75] Inventors: Dale W. Pressnall; Michael R. Keller; Robert E. Schwartz, all of Tulsa, Okla.

[73] Assignee: John Zink Company, Tulsa, Okla.

[21] Appl. No.: 125,249

[22] Filed: Nov. 25, 1987

[51] Int. Cl.[4] ..... F23J 1/02

[52] U.S. Cl. ..... 110/171; 110/259

[58] Field of Search ..... 110/165 R, 170, 171, 110/259

[56] References Cited

U.S. PATENT DOCUMENTS

| | | | |
|---|---|---|---|
| 524,688 | 8/1984 | Ransome . | |
| 1,160,360 | 11/1915 | Atterbury et al. . | |
| 2,090,622 | 8/1937 | Cruikshank | 110/101 |
| 3,504,645 | 4/1970 | Davenport | 110/8 |
| 3,566,809 | 3/1971 | Carry et al. | 110/8 |
| 3,680,503 | 8/1972 | Danielsson et al. | 110/13 |
| 4,137,051 | 1/1979 | Goodwin | 48/66 |
| 4,231,304 | 11/1980 | Hoskinson | 110/257 |
| 4,285,282 | 8/1981 | Good | 110/259 |
| 4,321,876 | 3/1982 | Mikus et al. | 110/165 R |

FOREIGN PATENT DOCUMENTS

| | | | |
|---|---|---|---|
| 157469 | 1/1921 | United Kingdom | 110/170 |

*Primary Examiner*—Edward G. Favors

*Attorney, Agent, or Firm*—Laney, Dougherty, Hessin & Beavers

[57] ABSTRACT

Apparatus for handling ash. A tank is filled with water and has the lower end thereof located at a substantial angle from horizontal. The tank is positioned beneath an incinerator to receive ash therefrom. An ash wheel having sectors defined by upright paddle elements has a portion thereof received beneath the water into which the ash falls and a portion thereof which extends over one edge of the tank. As the wheel rotates, ash is swept over the edge of the tank and onto a conveyor for disposal.

22 Claims, 4 Drawing Sheets

APPARATUS FOR HANDLING ASH

BACKGROUND OF THE INVENTION

1. Field of the Invention

The instant invention relates to ash handling apparatus and more particularly to such an apparatus which receives ash directly from an incinerator and delivers the same to a hopper, conveyor or the like for disposal.

2. Description of the Prior Art

Incinerators which burn a high volume of material, for example, municipal refuse incinerators, generate hot ash which creates an ash disposal problem. Most prior art techniques first quench the ash in water in order to reduce damage to metal surfaces which might otherwise be affected by the hot ash. One prior art apparatus comprises a tank having a slanted lower end. A pair of endless chains are mounted opposite one another and have steel bars disposed therebetween at selected intervals along each chain. The chains are positioned so that the bars ride against the slanted surface thereby collecting ash which is dropped into the water and which settles to the lower portion of the tank. The bars push the ash up the surface, over the edge and into a disposal hopper, conveyor or the like.

Such prior art apparatus creates serious maintenance problems. The ash essentially acts as a grinding compound and rapidly wears the articulated chain joints. In addition, any stringy material, such as wire, metal banding or the like which may be dropped into the water may become fouled in the chains and either jam or break the mechanism. In ash from an incinerator which burns municipal refuse, such items are commonplace.

There exists a need for an apparatus for handling ash which will not be as adversely affected as prior art apparatus by the grinding effect of the ash in the water.

There exists a need for such an apparatus which will not be easily fouled by stringy elements such as wire, metal banding or the like and which if jammed would provide a means for eliminating the jam.

SUMMARY OF THE INVENTION

The instant invention comprises a container having a substantially planar surface formed therein. The container is filled with liquid for receiving ash when the apparatus is in operative condition. An elongate paddle element is pivotally mounted on the planar surface and sweeps thereacross. Ash is thereby collected along the leading edge of the paddle element. Means are provided adjacent the container for receiving ash collected by the paddle element.

Numerous needs which are filled by the instant invention will be apparent to a person having ordinary skill in the art when the following detailed description is read in view of the accompanying drawings.

DETAILED DESCRIPTION OF THE PREFERRED EMBODIMENT OF THE INVENTION

Figure 1:
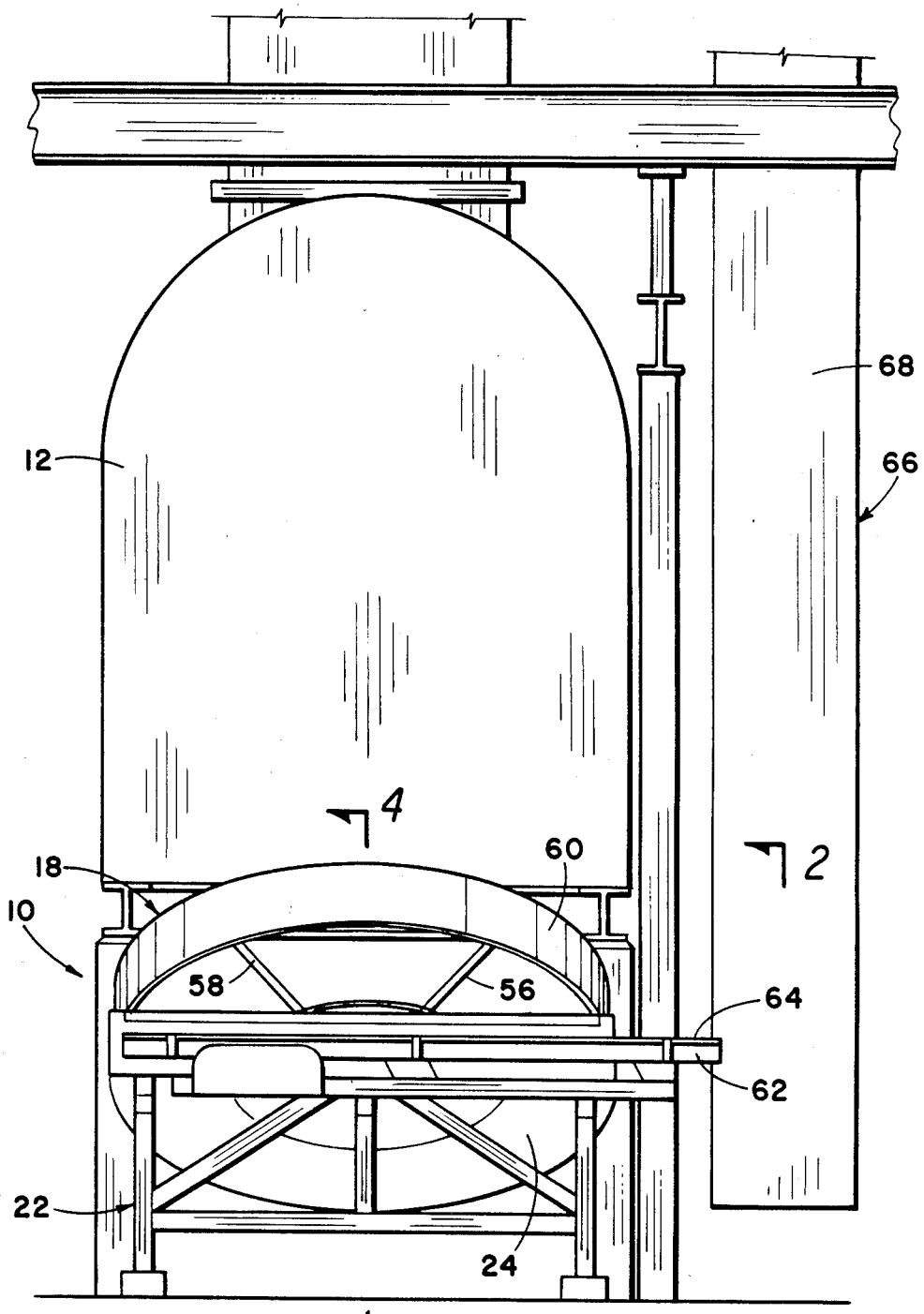
FIG. 1 is a view of an incinerator in combination with apparatus constructed in accordance with the instant invention.

Referring now to the drawings, indicated generally at 10 is ash handling apparatus constructed in accordance with the instant invention. The ash handling apparatus is installed substantially beneath an incinerator 12 which forms a part of a municipal waste incineration facility. It is to be appreciated that the instant invention may be used with other types of incinerators. The incinerator includes an ash disposal chute 14 having a lower end 16 from which hot ash is ejected.

Apparatus 10 includes therein a rotatable ash wheel 18, such also being referred to herein as a circular frame; a container or tank 20; and a stand 22 which supports the tank in position as shown. Tank 20 includes a substantially planar portion 24 having a substantially planar surface 26 formed on the upper side thereof. Planar portion 24 is also referred to herein as a first portion. Planar portion 24 includes a substantially straight side or edge 28. The perimeter of planar portion 24 is defined by edge 28 and an arc-shaped portion having ends adjoining either end of edge 28 and having a circumference centered about an axis 30 in FIG. 4.

An upright tank wall 32 includes an upper edge 34 and a lower edge which is sealingly connected to the arc-shaped edge of planar portion 24.

Figure 4:
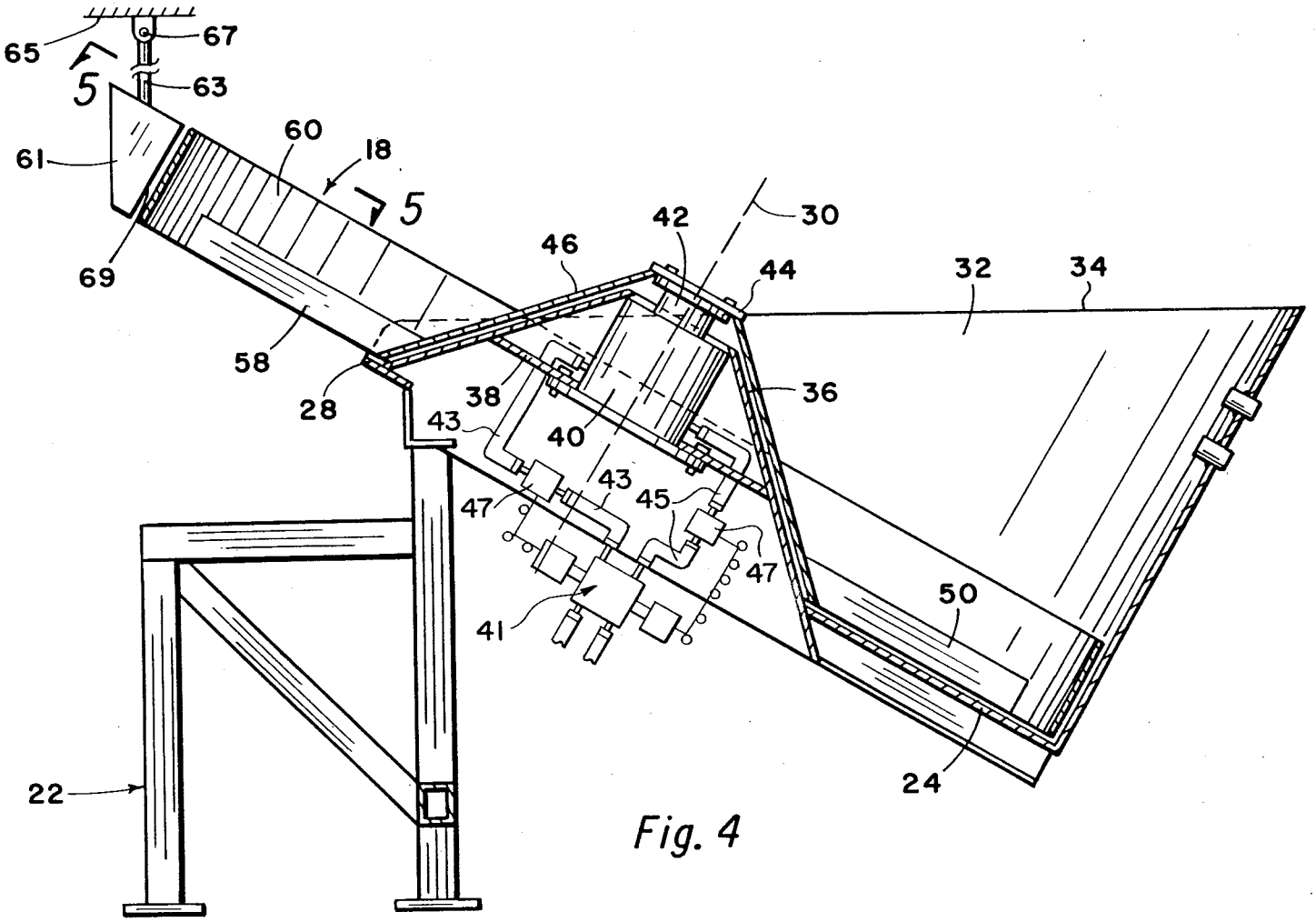
FIG. 4 is an enlarged view taken along line 4—4 in FIG. 1 and including a wheel striker.

A frusto-conical support base 36, in FIG. 4, extends upwardly from planar portion 24. Support base 36 includes an annular motor support plate 38 which is connected to the inner surface of support base 36 about the circumference thereof. An hydraulic motor 40 is mounted on plate 38 via bolts as shown. Motor 40 includes a shaft 42 to which a central circular portion 44 of ash wheel 18 is bolted.

Motor 40 is connected to hydraulic controls 41 which permit rotation of the motor 40 in either direction. In each of the two hydraulic lines 43 and 45 which provide fluid to or from the motor, depending upon the direction of rotation, there is a commercially available hydraulic pressure sensing device 47. If the pressure in the hydraulic input line rises above a preselected value, the hydraulic controls 41 cause motor rotation to reverse. The sensing device 47 is referred to herein as means for sensing the resistance to rotation while the controls 41 which cause the motor 40 to reverse direction is referred to herein as means for reversing the direction of rotation. It is to be appreciated that a person having ordinary skill in the art could easily design such hydraulic circuit controls.

Ash wheel 18 includes a central frusto-conical portion 46 which is connected about the upper circumference thereof to circular portion 44. Paddle elements 48, 50, 52, 54, 56, 58 each comprise an elongate planar member having one end secured to frusto-conical portion 46 and the other end secured to the radially inner surface of a cylindrical portion 60 of the ash wheel.

Figure 5:
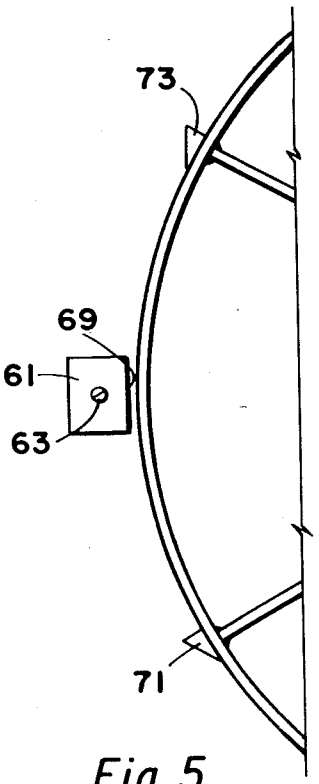
FIG. 5 is a partial view taken along line 5—5 in FIG. 4.
Figure 6:
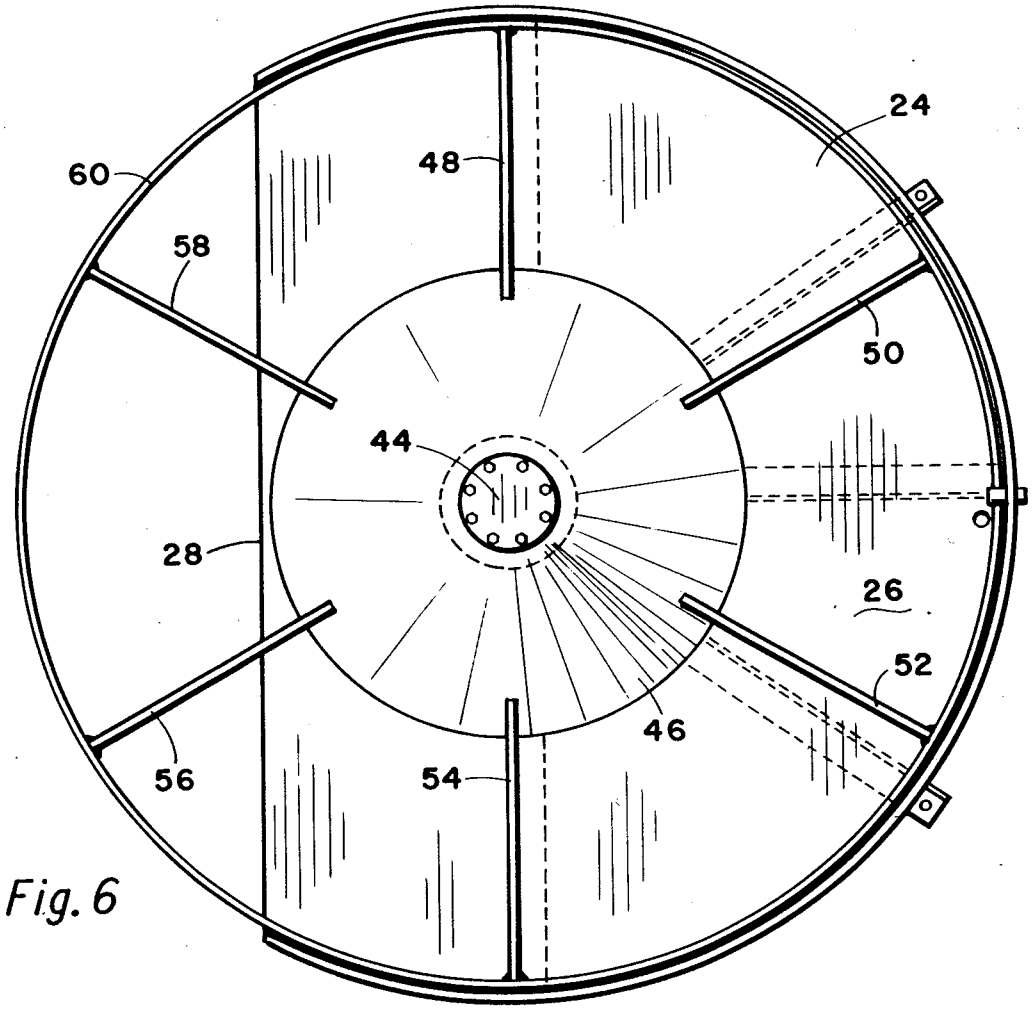
FIG. 6 is a full view similar to FIG. 5 excluding the wheel striker.

In FIGS. 4 and 5 only, a wheel striker 61 is shown. Wheel striker 61 comprises a weighted head which is suspended from a rod 63. The rod is pivotally attached to a support 65 via connector 67. A striking face 69 is formed on one side of wheel striker 61 and faces the radially outer surface of cylindrical portion 60. A purality of ramp elements, two of which are elements 71, 73, are mounted on the radially outer surface of cylindrical portion 60.

A commercially available conveyor 62 having a belt 64 along an upper portion thereof is supported on stand 22 beneath edge 28 of the tank. A second conveyor 66 (in FIG. 1) has one end thereof positioned beneath the rightmost end (as viewed in Figure 1) of conveyor 62 and includes a belt 68 thereon which extends rearwardly at an angle of approximately 30° from horizontal.

Figure 3:
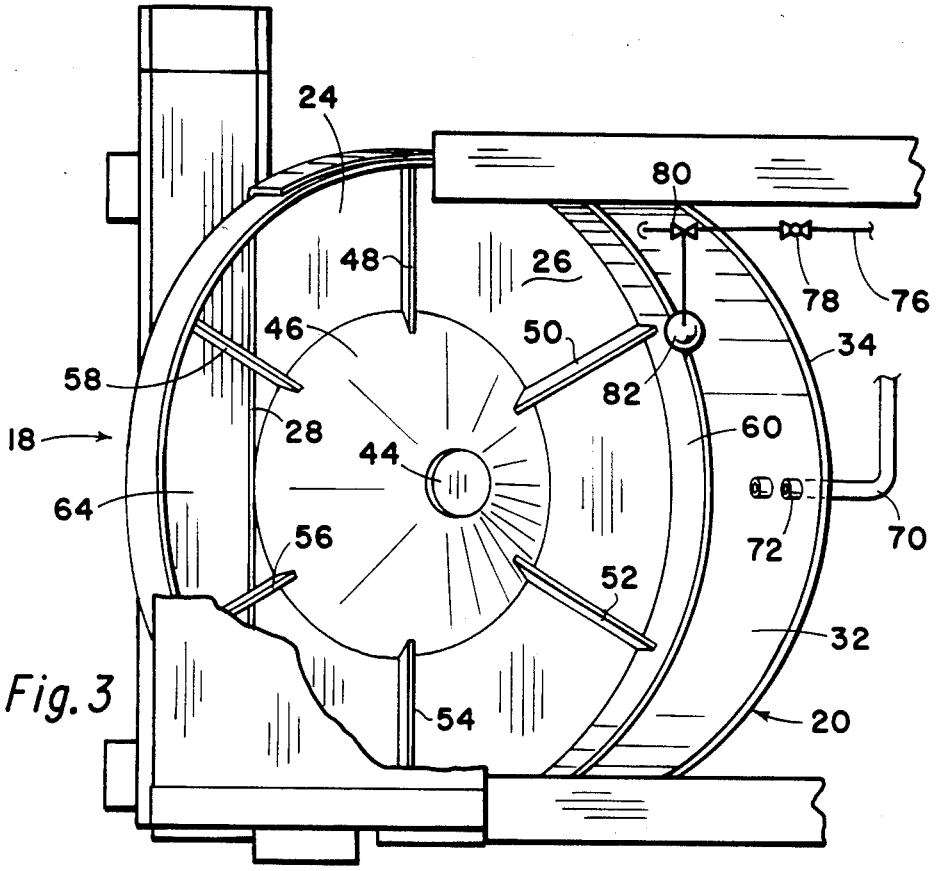
FIG. 3 is a view taken along line 3—3 in FIG. 2.
Figure 2:
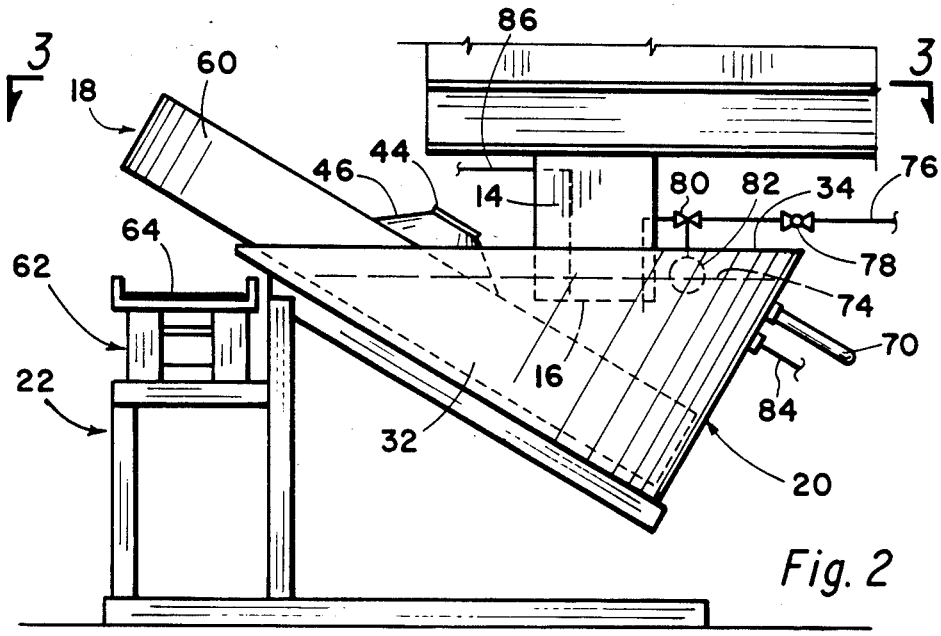
FIG. 2 is a view taken along line 2—2 in FIG. 1.

Finishing now the description of the structure of the instant embodiment of the invention, in FIGS. 2 and 3, a tank overflow line 70 is in fluid communication with the interior of the tank. One end 72 of the line extends into the tank and is in position to drain any water added to the tank when the water surface 74 is above the normal operating level. A water input line 76 includes a conventional valve 78 therein which, when opened, permits water to flow to one side of a float valve 80. The float valve includes a float 82 which, when surface 74 of the water is above the normal operating level, maintains valve 80 in a closed position. If water surface 74 should drop below the normal operating level, valve 80 is turned on and water is supplied into the tank from line 76. When the level again rises to the normal operating level, float 82 shuts valve 80 off.

A second fluid input line 84 provides fluid input from various other sources (not shown) in the waste incineration facility such as from a sump or from quench water. Thus, the tank may be initially filled with water via line 84 or line 76 and may thereafter be maintained in a filled condition under the action of float valve 80 and float 82 or by input from line 84. Line 76 is connected to the usual municipal water source.

An air line 86 is received within the water beneath chute 14. As ash is dumped into the water, the air agitates the water thereby sinking the ash and preventing bridging of ash on the surface of water between the chute sides.

Considering now the operation of ash handling apparatus 10, tank 20 is initially filled with water. Thereafter, as waste burns in incinerator 12, ash therefrom is deposited into the tank via chute 14. The water in the tank cools the hot ash which settles toward ash wheel 18. Hydraulic motor 40 is energized at all times when ash is provided to the tank thus rotating wheel 18 in a selected direction. As the ash settles toward the wheel, paddle elements 48–58 sweep ash along in front thereof. As each paddle element sweeps over edge 28, the ash pushed along in front of the paddle elements falls over edge 28 and onto conveyor belt 64. The wet ash is moved along the conveyor belt and dropped on conveyor 66 in FIG. 1 which carries the same away for disposal.

It should be noted that the ash removed from the tank carries with it a certain amount of water thus requiring water in the tank to be replenished. In addition, there may be significant losses due to evaporation. As the water level drops, float 82 opens float valve 80 thereby topping the tank off with water from line 76 to maintain the water level as shown in FIG. 2. Water levels may be maintained by water provided via line 84.

In the event that some unburned material or some wire or metal banding or the like causes jamming of wheel 18, the pressure sensor in the hydraulic controls senses the increase in pressure and when the same rises above a preselected value, the direction of rotation of motor 40 is reversed. Often reversal of direction releases the jam and permits the material, wire or the like to be swept by the paddle elements over edge 28 and onto the conveyor.

When operating the wheel in one direction only, a wheel striker, like wheel striker 61 in FIGS. 4 and 5 may be used to dislodge ash which may be stuck to wheel 18 thereby causing the ash to fall onto conveyor belt 64. As the wheel turns counterclockwise, in the view of FIG. 5, each ramp element, like elements 71, 73, urges striker 61 radially outwardly and then permit the striker to fall against the outer surface of the ash wheel thereby dislodging ash stuck to the wheel. Each of the ramp elements also serve to break up ash collected between the radially outer surface of wheel 18 and the radially inner surface of tank wall 32. If the wheel striker is not used, studs may be mounted on the outer surface of the wheel to break up ash which may collect in the annulus between the wheel and the tank wall.

It can be seen that apparatus constructed in accordance with the instant invention moves ash from a tank using a simpler motion (rotation) than prior art apparatus. In addition, the hydraulic motor and its connection to the wheel are isolated from the heat and abrasive effects of the water into which the ash is received. Apparatus embodying the instant invention is thus easier to build and maintain than prior art apparatus.

It is to be appreciated that additions and modifications may be made to the instant embodiment of the invention without departing from the spirit thereof which is defined in the following claims.

We claim:

1. Ash handling apparatus comprising:

a container having a substantially planar surface formed therein, said container being filled with liquid for receiving ash when said apparatus is in operative condition;

an elongate paddle element for sweeping across said planar surface thereby collecting such ash along the front thereof, said paddle element being pivotally mounted on said planar surface;

means for rotating said paddle element;

means for reversing the direction of rotation of said paddle element; and means adjacent said container for receiving ash collected along the front of said paddle element.

2. The apparatus of claim 1 wherein said planar surface is oriented at a substantial angle from horizontal.

3. The apparatus of claim 1 wherein said paddle element extends over one edge of said planar surface during a portion of each paddle element rotation.

4. The apparatus of claim 3 wherein said apparatus further comprises a plurality of paddle elements extending radially from a central rotational axis.

5. The apparatus of claim 1 wherein said container further comprises an upright wall extending from said planar surface.

6. The apparatus of claim 5 wherein said wall is in the shape of a circular arc.

7. The apparatus of claim 6 wherein said apparatus further includes:

a circular frame rotationally mounted on said planar surface; and a plurality of said paddle elements radially disposed in said frame.

8. The apparatus of claim 7 wherein said circular frame is arranged and constructed so that a portion thereof extends over an edge of said planar surface.

9. The apparatus of claim 8 wherein said planar surface is mounted on a stand which maintains the same at a substantial angle from horizontal and wherein said means adjacent said container is positioned beneath the edge of said planar surface over which said circular frame extends.

10. Apparatus for handling ash from an incinerator having an ash disposal chute extending downwardly therefrom, said apparatus comprising:

a container for receiving said disposal chute therein, said container being filled with liquid when said apparatus is in operative condition;

a circular frame having a plurality of upright paddle elements radially disposed therein, said frame having a portion thereof received beneath such liquid below said ash disposal chute and another portion thereof which extends above such liquid;

a support base having said circular frame mounted thereon for enabling rotation of said frame about the vertical axis thereof;

means for rotating said circular frame;

means for reversing the direction of rotation of said circular frame; and means for receiving ash collected in front of the paddle elements when said circular frame is so rotated, said receiving means being positioned beneath that portion of said circular frame which extends above such liquid.

11. The apparatus of claim 10 wherein said container includes a substantially planar surface upon which said support base is mounted.

12. The apparatus of claim 11 wherein a portion of said circular frame extends over an edge of said substantially planar surface.

13. The apparatus of claim 16 wherein said planar surface is fixed at a substantial angle from horizontal.

14. The apparatus of claim 19 wherein said container further includes a wall extending from said planar surface, said wall being substantially parallel to that portion of said circular frame which is received beneath such liquid.

15. The apparatus of claim 10 wherein said means for receiving ash collected in front of the paddle elements comprises a conveyor belt.

16. An apparatus for handling ash comprising:

a tank having a first portion in the shape of a circular arc with the ends thereof connected by a substantially straight line, said straight line portion defining a side of said tank;

an arc-shaped tank wall mounted on said lower end adjacent the arc-shaped portion thereof;

a circular frame rotatably mounted on said first portion, said frame being concentric with said arc-shaped tank wall and having a portion thereof extending over said tank side;

a plurality of paddle elements radially disposed in said frame and oriented substantially normal to said first tank portion;

a motor for rotating said frame;

means for reversing the drive direction of said motor; and means for receiving said ash positioned beneath that portion of said circular frame which extends over the side of said tank.

17. The apparatus of claim 16 wherein said apparatus further includes a stand for supporting said tank so that said tank side is higher than the remainder of said first portion.

18. The apparatus of claim 16 wherein said means for receiving said ash comprises a conveyor belt.

19. Ash handling apparatus comprising:

a container having a substantially planar surface formed therein, said container being filled with liquid for receiving ash when said apparatus is in operative condition;

a plurality of elongate paddle elements pivotally mounted on said planar surface for sweeping across said planar surface thereby collecting such ash along the fronts of said paddle elements, said paddle elements extending radially from a central rotational axis and each said paddle element extending over one edge of said planar surface during a portion of said paddle element's rotation;

means adjacent said container for receiving ash collected along the fronts of said paddle elements;

means for rotating said paddle elements; and means for reversing the direction of rotation of said paddle elements.

20. The apparatus of claim 19 wherein said planar surface is oriented at a substantial angle from horizontal.

21. Ash handling apparatus comprising:

a container, said container being filled with liquid for receiving ash when said apparatus is in operative condition, said container including:

a substantially planar surface; and an upright wall extending from said planar surface, said wall being in the shape of an arc;

a circular frame rotationally mounted on said planar surface;

a plurality of elongate paddle elements radially disposed in said frame for sweeping across said planar surface thereby collecting such ash along the fronts of said paddle elements;

means for rotating said circular frame;

means for sensing the resistance to rotation of said circular frame;

means for reversing the direction of rotation of said circular frame responsive to an increase in resistance to rotation above a preselected level; and means adjacent said container for receiving ash collected along the fronts of said paddle elements.

22. An apparatus for handling ash comprising:

a tank having a first portion in the shape of a circular arc with the ends thereof connected by a substantially straight line, said straight line portion defining a side of said tank;

an arc-shaped tank wall mounted on said lower end adjacent the arc-shaped portion thereof;

a circular frame rotatably mounted on said first portion, said frame being concentric with said arc-shaped tank wall and having a portion thereof extending over said tank side;

a plurality of paddle elements radially disposed in said frame and oriented substantially normal to said first tank portion;

means for rotating said frame;

means for periodically striking said frame; and means for receiving said ash positioned beneath that portion of said circular frame which extends over the side of said tank.

* * * * *

UNITED STATES PATENT AND TRADEMARK OFFICE

CERTIFICATE OF CORRECTION

PATENT NO. : 4,798,150

DATED : January 17, 1989

INVENTOR(S) : Dale W. Pressnall et al.

It is certified that error appears in the above-identified patent and that said Letters Patent is hereby corrected as shown below:

Column 5, line 35 (claim 13), change "16" to --12--;
and
Column 5, line 37 (claim 14), change "19" to --13--.

Signed and Sealed this

Twentieth Day of June, 1989

*Attest:*

DONALD J. QUIGG

*Attesting Officer*

*Commissioner of Patents and Trademarks*